United States Patent [19]

Schurr

[11] 4,430,001

[45] Feb. 7, 1984

[54] INJECTOR MIXER APPARATUS

[75] Inventor: George A. Schurr, Newark, Del.

[73] Assignee: E. I. Du Pont de Nemours & Co., Wilmington, Del.

[21] Appl. No.: 306,593

[22] Filed: Sep. 28, 1981

Related U.S. Application Data

[63] Continuation-in-part of Ser. No. 106,402, Dec. 26, 1979, abandoned.

[51] Int. Cl.[3] ..... B01F 5/04; B01F 13/02

[52] U.S. Cl. ..... 366/107; 366/101; 366/163; 366/177; 366/181

[58] Field of Search ..... 366/11, 20, 35, 38, 366/40, 76, 96, 101, 106, 107, 133, 134, 366/154–156, 160, 167, 173, 177, 181, 182, 341, 348, 366/349; 427/212, 213, 220, 221; 118/303

[56] References Cited

U.S. PATENT DOCUMENTS

| | | | |
|---|---|---|---|
| 2,746,728 | 5/1956 | Pomerleau . | |
| 3,295,838 | 1/1967 | Ban . | |
| 3,709,828 | 1/1973 | Marks | 366/177 X |
| 3,837,583 | 9/1974 | Kugelberg et al. . | |
| 4,050,677 | 9/1977 | Benthin | 366/11 |
| 4,083,946 | 4/1978 | Schurr et al. . | |
| 4,086,663 | 4/1978 | Croft | 366/177 X |

*Primary Examiner*—Timothy F. Simone

[57] ABSTRACT

An apparatus and process for uniformly mixing a relatively small amount of material with a relatively large amount of another material in particulate form by introducing the smaller amount of material via a pipe within another concentric pipe through which a high pressure gas is introduced which thereby provides a zone of turbulence into which a particulate material in larger amounts is introduced, the mixture of gas and materials being transported through a treatment chamber to produce a uniform mixture.

4 Claims, 1 Drawing Figure

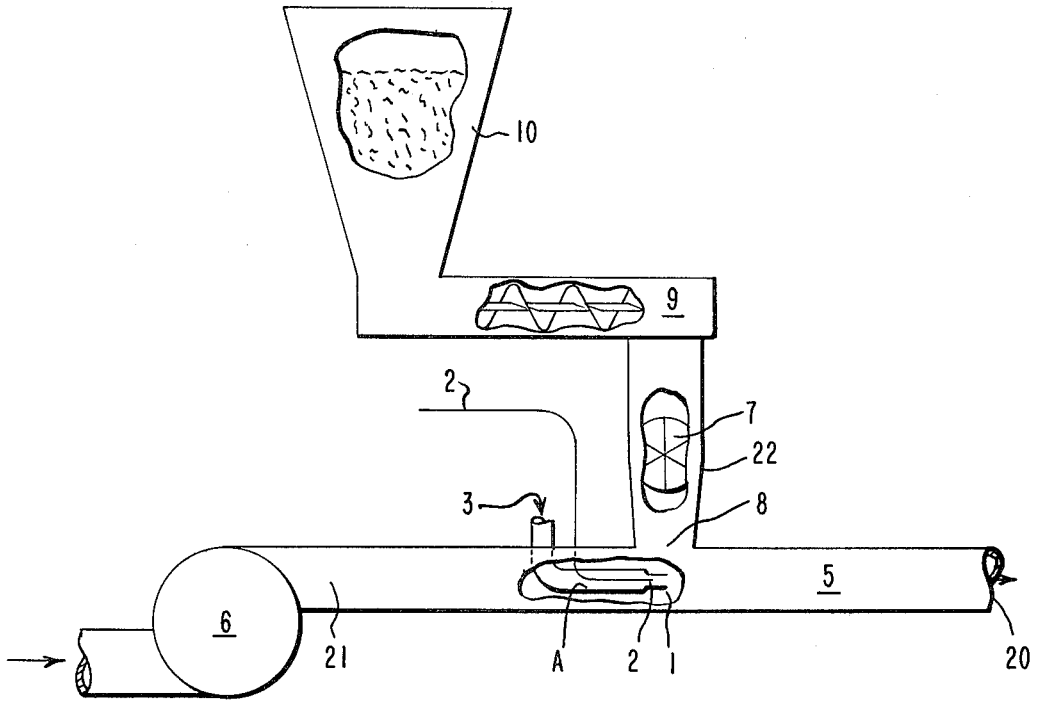
10
9
2
7
22
3
8
5
6
21
A
2
1
20

INJECTOR MIXER APPARATUS

CROSS REFERENCE TO RELATED APPLICATION

This is a continuation-in-part of copending application Ser. No. 106,402, filed Dec. 26, 1979, abandoned.

DESCRIPTION

1. Technical Field

This invention relates to an improved apparatus for mixing a small fraction of one material with a large fraction of another particulate material. More particularly, this invention relates to an improved apparatus for mixing a small fraction of one material with a large fraction of another particulate material having means for introducing the small fraction of one material into a stream of the large fraction of particulate material in a high and a low velocity gas stream.

2. Background Art

U.S. Pat. No. 2,746,728 discloses an apparatus for mixing solids and liquids to obtain a uniform product that does not involve any moving parts by injecting the liquids through multiple nozzles.

U.S. Pat. No. 3,295,838 discloses an apparatus without moving parts with a venturi-type spray chamber for premoistening solids with a fine moisture spray in the throat of the venturi section to provide uniform blending of liquids with powders.

U.S. Pat. No. 3,837,583 discloses an apparatus for multiple-stage milling of a material with a pressurized gas or steam. The apparatus is limited to uses involving milling of pigment.

U.S. Pat. No. 4,083,946 discloses an apparatus for removing chloride impurities from $TiO_2$ having means for injecting a gas stream at sonic or supersonic velocity into a chamber crosscurrent to $TiO_2$. Relatively large amounts of gas are used relative to the $TiO_2$.

However, none of the above apparatuses permit the uniform mixing of a small fraction with a large fraction.

DISCLOSURE OF THE INVENTION

Now an apparatus has been discovered that uniformly mixes very small amounts of materials and very large amounts of different materials in particulate form. Accordingly, an apparatus has been discovered for uniformly mixing a relatively small amount of material with a relatively large amount of another material in particulate form comprising a conveyer-pipe treatment chamber with a feed end and a discharge end, a nozzle for introducing a mixture of a high pressure gas and the relatively small amount of material to be mixed having a discharge end housed within the conveyer-pipe treatment chamber and means for feeding the particulate material into an opening in the conveyer-pipe treatment chamber at the feed end, said nozzle comprising an inner tube, from which the relatively small amount of material exits, concentrically arranged within an outer tube to form an annular opening between the outer tube and the inner tube from which the high pressure gas stream exits, said inner tube being shorter than the outer tube to permit the contents of the inner tube to be affected by the contents of the outer tube before reaching the discharge end of the nozzle, said opening in the feed end of the conveyer-pipe treatment chamber located to permit particulate material to enter above the nozzle discharge end, said nozzle discharge end located within the conveyer-pipe treatment chamber so that the longitudinal axis of the nozzle and the conveyer-pipe treatment chamber are parallel, said nozzle discharge end positioned in said conveyer-pipe treatment chamber so that the nozzle discharge end is beneath the opening to the conveyer-pipe treatment chamber and within a vertical projection of the opening area so that at least some of the material in particulate form can freely fall by gravity across the discharge end of the nozzle, the entrance end or the discharge end of the conveyer-pipe treatment chamber having means to cause a flow of low pressure gas to enter and flow parallel to the flow of high pressure gas. The mixture exits from the conveyer-pipe treatment chamber uniformly mixed and can be bagged or otherwise contained and transported for further use.

The process for obtaining a uniform mixture of a relatively small amount of material amounting to 0.05–6% by weight based on the mixture with a relatively large amount of another material in particulate form amounting to 99.95–94% by weight based on the mixture comprises injecting a high velocity gas stream into a conveyer-pipe treatment chamber while atomizing the small amount of material to be mixed into the high velocity gas stream by discharging the small amount of material from an inner tube within an outer tube or nozzle thereby atomizing the small amount of material before exiting the nozzle, the high velocity gas stream creating a zone of turbulence with the atomized material exiting the nozzle, adding the particulate material into the zone of turbulence, supplying a low velocity gas stream at the inlet to the conveyer-pipe treatment chamber parallel to the high velocity gas flow and conveying the gas and materials to be mixed through the conveyer-pipe treatment chamber, the ratio of high velocity gas to low velocity gas being more than 3:1.

The invention can also be described by referring to the FIGURE which is a schematic drawing of the apparatus of the invention.

DESCRIPTION OF THE DRAWING

Referring now to the FIGURE, conduit 22 is connected to feed opening 8 and is equipped with a rotary valve 7 mounted within conduit 22. Screw feeder 9 is connected to supply chamber 10 and on the discharge side to conduit 22. Particulate material enters through supply chamber 10 and is transported and metered by the screw feeder 9 to conduit 22 through rotary valve 7 which provides a seal against gases from conveyer-pipe treatment chamber 5, into conveyer-pipe treatment chamber 5 above nozzle 1, said conduit 22 being of uniform cross-sectional area. The material to be mixed with the particulate material enters through tube 2 which discharges within annular space A at a controlled rate. A gas under high pressure is supplied through pipe 3 through annular space A and exits nozzle 1 at a high velocity with already atomized or dispersed material from tube 2. Blower 6 supplies a gas at low velocity to the entrance end 21 of conveyer-pipe treatment chamber 5. Nozzle 1 is mounted in the center of conveyer-pipe treatment chamber 5 within a vertical projection of the opening 8 to the chamber, preferably so that the end of the nozzle 1 is at the vertical center line of the opening 8. The particulate material encounters a zone of turbulence generated by the discharge of nozzle 1. The turbulence subjects the material from tube 2 to shear forces that disperse and mix it intimately and finely with the particulate material. The mixture is pneumatically conveyed to the discharge end 20 of the conveyer-pipe treatment chamber 5.

Generally, uniform mixing can be obtained with gas velocity ratios of high velocity to low velocity of more than 3:1. Preferably, the ratio of high velocity to low velocity is 4:1–10:1.

Conveyer-pipe treatment chamber 5 is generally circular in cross section but may also have a square, oval or other shape. Likewise, opening 8 may have a circular, oval, rectangular or other cross sectional shape.

Blower 6 can be eliminated and a fan or similar apparatus used at the discharge 20 of conveyer-pipe treatment chamber 5 to suck gas into the entrance end. In such a case, rotary valve 7 is not needed.

The material that exits tube 2 is the material that is relatively small in amount compared to the particulate material that is fed to 10 and may be in solid, liquid or slurry form. Tube 2 ends within the annular space A before the end of nozzle 1. Thus the high pressure gas will have an affect on the form of the material from tube 2 before it leaves the nozzle 1. The high velocity gas must be able to move the material from tube 2 through the nozzle exit. The high velocity gas disperses this material into particles that are deposited on the particulate material uniformly.

The velocity through the throat of nozzle 1 is 300 ft/sec or greater. Generally, the high velocity gas is discharged from nozzle 1 at 300–2000 ft/sec (90–600 meters per second) and the low velocity gas at 80–100 ft/sec (24–30 meters per second). Thus, about 4–33% of the total gas flow entering chamber 5 is at high velocity.

The apparatus of the invention is useful in mixing relatively small amounts of one material with relatively large amounts of another material in particulate form. One specific use is in mixing naphthenic acid with titanium dioxide particles in small amounts, generally 0.1–2% by weight based on the titanium dioxide. The naphthenic acid imparts improved flowability to the titanium dioxide particles in the quantities recited. Tests of carbon content of various samples of naphthenic acid/titanium dioxide mixtures indicated a consistent overall content of naphthenic acid that is indicative of uniform mixing. The improved flowability of titanium dioxide is also indicative of uniform mixing.

The following test assesses the relative flowability of $TiO_2$ pigment which correlates with actual experience in unloading covered rail hopper cars. A 0.25 $m^3$ cylindrical hopper is equipped with a 10 cm discharge hole, air slide and vibrator at the bottom. A 70 kg sample of the pigment to be tested is charged to this hopper. The sample and hopper are then shaken for 4 hours on a special shaker table which subjects the hopper to the acceleration forces encountered in rail and truck travel. This shaking compacts the sample in the hopper.

The flowability properties of the pigment is then tested by unloading through the discharge port with both air slide and vibrator actuated. A free flowing pigment is one which readily discharges from the hopper. Pigments which bridge or rat hole will not freely discharge and must be scooped or rodded from the hopper.

The following examples illustrate the use of the apparatus in mixing a small amount of one material with a large amount of another material in particulate form. All parts, percentages and proportions that may appear in the examples are by weight unless otherwise indicated.

EXAMPLE 1

The apparatus illustrated in the FIGURE having a tube 12 3/16 inch (4.8 mm) O.D. and ⅛ inch (3.2 mm) I.D., a nozzle 1 1.315 inches (33.3 mm) O.D. and 1.049 inches (26.6 mm) I.D., a twin screw feeder 9, a Young rotary valve 7, an opening 8, 4 inches (101.6 mm) in diameter into conveyer-pipe reaction chamber 5 which was 4.5 inches (115 mm) O.D. and 4 inches (100 mm) I.D. and 60 ft (18 m) in length was used to mixed naphthenic acid with titanium dioxide in fine particulate form in the amounts indicated. Naphthenic acid feed dissolved in alcohol was metered through tube 2 while titanium dioxide in particulate form was metered through feeder 9. Blower 6 provided low pressure air and nozzle 1 provided high pressure air. Samples treated as described were found to flow freely when tested for flowability. Additional tests were made with the apparatus at naphthenic acid concentrations of 0.05–2.0%. All samples in which greater than 0.2% naphthenic acid flowed freely while untreated samples and samples treated at less than 0.2% naphthenic acid did not flow freely from the test hopper.

EXAMPLE 2 (BEST MODE)

Twenty tons of the $TiO_2$ were treated by the apparatus described in Example 1 with 0.3% by weight naphthenic acid based on the $TiO_2$. Seventy kg samples were collected at periodic intervals during this testing. These were all evaluated on the flowability test and were found to be free flowing.

EXAMPLE 3 (BEST MODE)

A $TiO_2$ pigment having 0.12% alumina and 0.08% silica surface treatment having a mean particle size less than 1 micron was treated with 0.03–2% by weight naphthenic acid as described in Example 1. This pigment without naphthenic acid was found to have poor flowability. The treated pigment of this example was tested for flowability and the samples with 0.05–0.1% by weight naphthenic acid flowed freely. All others were not free flowing.

Comparative Example A

An untreated $TiO_2$ pigment having a mean particle size of less than 1 micron was spread out to a depth of 1 cm on a tray. A total of 0.14 kg of naphthenic acid was uniformly sprayed on 70 kg of sample $TiO_2$ pigment. This sample was then collected and blended for 30 minutes in a V-cone blender. It was tested for flowability according to the previously described test. It would not freely discharge from the test hopper due to rat holing. A 70 kg sample of the same pigment without naphthenic acid was also tested for flowability. Its flowability was the same as the treated sample, that is, it was not free flowing.

INDUSTRIAL APPLICABILITY

The present invention is useful industrially to mix relatively small quantities of one material with relatively large quantities of another material in particulate form whereby a uniform mixture is obtained. There are many such industrial applications, among which one is the application of small amounts of naphthenic acid to large amounts of $TiO_2$ to render the $TiO_2$ more flowable than untreated $TiO_2$.

I claim:

1. An apparatus for uniformly mixing a relatively small amount of material with a relatively large amount of another material in particulate form comprising a conveyer-pipe treatment chamber with an entrance end, a feed opening and a discharge end, a nozzle for introducing a mixture of a high pressure gas and the relatively small amount of material to be mixed having a discharge end housed within the conveyer-pipe treatment chamber and means for feeding the particulate material into said feed opening in the conveyer-pipe treatment chamber, said nozzle comprising an inner tube, from which the relatively small amount of material exits, concentrically arranged within an outer tube to form an annular opening between the outer tube and the inner tube from which the high pressure gas stream exits, said inner tube being shorter than the outer tube to permit the contents of the inner tube to be affected by the contents of the outer tube before reaching the discharge end of the nozzle, said feed opening located to permit all the particulate material to enter above the nozzle discharge end, said nozzle discharge end located within the conveyer-pipe treatment chamber so that the longitudinal axis of the nozzle and the conveyer-pipe treatment chamber are parallel, said nozzle discharge end positioned in said conveyer-pipe treatment chamber so that the nozzle discharge end is beneath the feed opening to the conveyer-pipe treatment chamber and within a vertical projection of the feed opening so that at least some of the material in particulate form can freely fall by gravity across the discharge end of the nozzle, the conveyer-pipe treatment chamber having means to cause a flow of low pressure gas to enter and flow parallel to the flow of high pressure gas.

2. The apparatus of claim 1 wherein the discharge end of the nozzle is located at the center line projection of the feed opening to the conveyer-pipe treatment chamber.

3. A process for uniformly mixing a relatively small amount of material amounting to 0.05–6% by weight based on the mixture with a relatively large amount of another material in particulate form amounting to 99.95–94% by weight based on the mixture comprising injecting a high velocity gas stream into a conveyer-pipe treatment chamber while atomizing the small amount of material to be mixed into the high velocity gas stream by discharging the small amount of material from an inner tube within an outer tube or nozzle thereby atomizing the small amount of material before exiting the nozzle, the high velocity gas stream creating a zone of turbulence with the atomized material exiting the nozzle, adding the particulate material into the zone of turbulence, supplying a low velocity gas stream at the inlet to the conveyer-pipe treatment chamber parallel to the high velocity gas flow and conveying the gas and materials to be mixed through the conveyer-pipe treatment chamber, the ratio of high velocity gas to low velocity gas being more than 3:1.

4. The process of claim 3 wherein the relatively small amount of material is in liquid form and the relatively large amount of another material is in solid particulate form.

* * * * *